US008490974B2

(12) United States Patent
Stolten

(10) Patent No.: US 8,490,974 B2
(45) Date of Patent: Jul. 23, 2013

(54) THREE-DIMENSIONAL PUZZLE OR PUZZLE OR DISPLAY PLATFORM

(75) Inventor: Mark Randall Stolten, Auckland (NZ)

(73) Assignees: Mark Randall Stolten, Auckland (NZ); Elizabeth Mary Stolten, Auckland (NZ); Frederick Brian Worrall, Tauranga (NZ)

( * ) Notice: Subject to any disclaimer, the term of this patent is extended or adjusted under 35 U.S.C. 154(b) by 855 days.

(21) Appl. No.: 11/665,998

(22) PCT Filed: Oct. 21, 2005

(86) PCT No.: PCT/NZ2005/000279

§ 371 (c)(1),
(2), (4) Date: Oct. 26, 2007

(87) PCT Pub. No.: WO2006/043840

PCT Pub. Date: Apr. 27, 2006

(65) Prior Publication Data

US 2010/0308536 A1 Dec. 9, 2010

(30) Foreign Application Priority Data

Oct. 22, 2004 (NZ) ..... 536138
Jul. 21, 2005 (NZ) ..... 541405

(51) Int. Cl.
*A63F 9/08* (2006.01)

(52) U.S. Cl.
USPC ..... 273/153 S

(58) Field of Classification Search
USPC ..... 273/156, 153 S, 157 R; 434/301
See application file for complete search history.

(56) References Cited

U.S. PATENT DOCUMENTS

| | | | | | |
|---|---|---|---|---|---|
| 1,409,082 | A | * | 3/1922 | Corbett | 273/157 R |
| 3,659,360 | A | * | 5/1972 | Zeischegg | 273/157 R |
| 3,906,804 | A | | 9/1975 | Atkinson | |
| 4,513,970 | A | * | 4/1985 | Opresco et al. | 273/153 S |
| 4,522,401 | A | | 6/1985 | Gustafson | |
| 4,600,199 | A | * | 7/1986 | Krell | 273/153 S |
| 5,100,359 | A | * | 3/1992 | Gorio | 273/157 R |
| 5,182,533 | A | | 1/1993 | Ritts | 335/306 |
| 5,340,349 | A | * | 8/1994 | Berg-Fernstrum | 446/901 |
| 5,411,262 | A | | 5/1995 | Smith | 273/157 |
| 5,566,941 | A | * | 10/1996 | Destics | 273/153 S |
| D397,376 | S | | 8/1998 | Hwang | D21/460 |
| 5,816,571 | A | | 10/1998 | Chen | 273/153 |
| 5,826,872 | A | * | 10/1998 | Hall | 273/156 |
| 6,017,220 | A | | 1/2000 | Snelson | |
| 6,116,979 | A | * | 9/2000 | Weber | 273/157 R |
| 6,158,740 | A | * | 12/2000 | Hall | 273/156 |
| 6,644,665 | B1 | | 11/2003 | Brooks | 273/153 |
| 6,739,938 | B2 | | 5/2004 | Dokoupil | 446/129 |
| 6,799,462 | B1 | | 10/2004 | Berstis | |

(Continued)

FOREIGN PATENT DOCUMENTS

| | | |
|---|---|---|
| GB | 2269760 A | 2/1994 |
| WO | WO91/03293 | 3/1991 |

*Primary Examiner* — Steven Wong
(74) *Attorney, Agent, or Firm* — Jacobson Holman PLLC

(57) ABSTRACT

A three-dimensional puzzle or puzzle or display platform being substantially spherical and having a substantially tessellated surface defined by substantially square form areas (first playing piece) and substantially triangular form areas (second playing piece), and having at least two parallel planes of demarcation on each of the three Cartesian axes that define the areas of the surface, and wherein the chord length of both form areas and the triangular form areas are substantially similar. The puzzle or game platform may be in conjunction with a levitator.

48 Claims, 7 Drawing Sheets

U.S. PATENT DOCUMENTS 7,110,236 B2 * 9/2006 Joachim ..... 361/139
2002/0135125 A1 9/2002 Wu
2005/0029735 A1 * 2/2005 Liu et al. ..... 273/156
2008/0230989 A1 * 9/2008 Chen ..... 273/156

* cited by examiner

THREE-DIMENSIONAL PUZZLE OR PUZZLE OR DISPLAY PLATFORM

This is a national stage of PCT/NZ05/000279 filed Oct. 21, 2005 and published in English.

FIELD OF THE INVENTION

The invention relates to puzzles and toys. More particularly the invention relates three-dimensional objects formed from multiple interrelated puzzle pieces.

BACKGROUND

Three-dimensional puzzles typified by Rubik's cubes and sphere-like puzzles have been known in the art.

It is an object of the present invention to provide a new three-dimensional puzzle or display platform.

Accordingly it is an aspect of the present invention to provide an improved three-dimensional puzzle or display platform which will at least provide the public with a useful choice.

Other objects of the invention may become apparent from the following description which is given by way of example only.

BRIEF DESCRIPTION OF THE INVENTION

In a further aspect the present invention is a three-dimensional puzzle or puzzle or display platform of a kind having magnetic interactions between a solid or non-solid core and plural pieces held, with or without contact, to a spherical core, wherein the plural pieces are of two kinds that collectively provide a substantially tessellated surface, and wherein one type of piece is at least notionally square when viewed towards the core and the second type of piece is at least notionally triangle when viewed towards the core, and wherein the chord lengths of each piece, four for each at least notionally square piece and three for each at least notionally triangle piece, are substantially equal.

In a further aspect the present invention is a three-dimensional puzzle or display platform having a substantially tessellated surface ("tessellated" or "substantially tessellated" being as herein defined and not dependent on a single repeating form), that can be considered substantially spherical, wherein a plurality of equally spaced parallel planes of demarcation on each of the three Cartesian axis can be considered as substantially defining the forms of the areas such to define both substantially square form areas and substantially triangular form areas and wherein that the chord length of both substantially square form areas and substantially triangular form areas are substantially similar.

In a further aspect the present invention is a three-dimensional spherical puzzle or display platform wherein the surface (irrespective of whether regular or irregular) essentially can be considered, when viewed in projection towards a notional centre, has areas of at least two kinds, a) a first playing piece defining a generally square form and b) a second playing piece defining a generally triangular form, and wherein said puzzle or platform has a capability whereby bands of playing pieces can be rotated about a notional spherical centre, and wherein said puzzle or platform has a capability whereby caps of playing pieces can be rotated about a notional spherical centre relative to said bands.

Preferably said playing pieces of said three-dimensional puzzle or display platform comprises are arranged symmetrically around a centroid.

In a further aspect the invention is a three-dimensional spherical puzzle divided into a number of playing pieces, said playing pieces individualised by planes of demarcation, wherein said planes of demarcation are arranged symmetrically in respect to an equatorial plane in each of the three Cartesian axis, and wherein said equatorial plane may or may not be a plane of demarcation.

In a further aspect the present invention is a three dimensional puzzle, said puzzle comprising a) a centroid, b) at least two puzzle pieces (optionally integrally moulded), comprising an area and a connector (optionally integrally moulded), wherein each said connector is comprised of a spacer and a connector element, wherein said area of each puzzle pieces have a distinct form, and wherein each puzzle piece indexes with at least one or more of another puzzle piece, and wherein the indexing surfaces of each said puzzle piece are of substantially similar length.

Preferable at least one of said playing pieces comprises an area that is substantially of a square form.

Preferable at least one of said playing pieces comprises an area that is substantially of a triangular form.

In a further aspect the present invention is a three dimensional puzzle, said puzzle comprising a centroid and at least two or more puzzle pieces ("playing pieces") peripheral to said centroid, wherein each said at least two or more puzzle pieces are comprised of a connector and a distinct moveable playing piece (optionally integrally moulded), wherein the display area of each said two or more playing piece are of a distinct shape having a distinct number of sides, wherein said connector connects said area to said centroid, wherein each distinct area of each playing piece associate with one another to form an outer surface and are moveable relative to said centroid, and wherein the length of the indexing side of each area is of substantially similar length to the length of the side to which said playing piece is indexed.

Preferable at least one of said playing pieces comprises an area that is substantially of a square form.

Preferable at least one of said playing pieces comprises an area that is substantially of a triangular form.

In yet a further aspect of the present invention consists in a three-dimensional puzzle as aforesaid in any of its forms wherein the styles of movement are essentially as follows:

a) rotation of bands of playing pieces around a first, second or third Cartesian axis, said axis passing through the centre of said centroid and said band comprising a ring of playing pieces, b) rotation of a cap of playing pieces around said axis; said cap playing pieces.

In one embodiment said bands are comprised solely of substantially square form playing pieces. Preferably said bands lie symmetrically over an equatorial line, and said bands are replicated in each of the three Cartesian axis.

In one embodiment said bands are comprised of both substantially square form playing pieces and substantially triangular form playing pieces. Preferably, those bands comprised of both types of pieces lie as dual bands either side of an equatorial demarcation line, and are replicated in each of the three Cartesian axis.

In one embodiment said three-dimensional sphere comprises twenty-six playing pieces of which eighteen are of the substantially square form and eight are of the substantially triangular form. Preferably the substantially square form playing pieces are arranged in three equatorial bands, comprising eight square form playing pieces each, along each of the three Cartesian axis.

In one embodiment, said three-dimensional sphere comprises sixty-two playing pieces of which thirty are of a substantially square form and thirty two are of a substantially triangular form. Preferably said substantially square form playing pieces are arranged in three equatorial bands, comprising twelve square form playing pieces each, along each of the three Cartesian axis.

In one embodiment said three-dimensional sphere comprises fifty-four playing pieces of which thirty are of the substantially square form and twenty-four are of the substantially triangular form. Preferably said substantially square form playing pieces and substantially triangular form playing pieces are arranged in dual equatorial bands along each of the three Cartesian axis. Preferably said arrangement of dual equatorial bands are repeated in each of the three Cartesian axis. Preferably each band comprises eight substantially square form playing pieces and four substantially triangular playing pieces.

In one embodiment of said puzzle as foresaid, said individual areas may be the in the form of a tile connected by a connector (integral or otherwise) to a centroid.

In one embodiment, said playing pieces are moved between playing positions.

In a further embodiment there is present magnetic interaction within said three-dimensional puzzle via any one or more of the following interactions:

between said adjacent playing pieces, between said playing pieces and said centroid, or between said adjacent playing pieces and also between said playing pieces and said centroid.

In one embodiment the movement of said playing pieces between playing positions provides feedback to the user. Said feedback allows the user to determine when the playing pieces are indexed correctly into a playing position. Preferably said feedback during movement provides at least one or more of the following outcomes:

a) a sense of moving beyond an indexed position, and b) a sense of indexing to a correct playing position.

In one embodiment said feedback mechanism is a noise, a "feel" i.e. due to a physical mechanism, or a change in a physical feature of said three-dimensional sphere that can indicate to the user when the playing pieces are moved, or correctly indexed to a playing position.

In one embodiment said feedback mechanism is provided by a ratcheting mechanism which provides a sound and/or a feel when said playing pieces are moved.

Preferably said feedback is due to the interaction between said ratcheting mechanism and a physical projection that interacts with said ratcheting mechanism.

In one embodiment said ratcheting mechanism is localised on the surface of a said playing piece. Preferably said ratcheting mechanism is localised on said substantially square form playing piece.

In one embodiment said physical projection is in the form of a projection that is on a playing piece that does not have localised thereto a ratcheting mechanism. Preferably said physical projection is able to interact with said ratcheting mechanism to provide feedback to the user as to when a playing piece is moved.

In one embodiment wherein said ratcheting mechanism is localised on said substantially square form playing piece, said physical projection is localised on said substantially triangular form playing piece. Preferably said physical projection is in the form of a ball bearing or the like.

In one embodiment said ball bearing is projected from a cavity in the side of said substantially triangular form playing piece so as to interact with said ratcheting mechanism.

In one embodiment said ball bearing is connected to a spring mechanism which causes said ball bearing to exert pressure on said ratcheting mechanism.

In one embodiment the feedback allowing the user to sense when the playing piece are correctly indexed is provided for by an indentation in the side of the playing piece which interacts with said playing piece containing the ball bearing. In this embodiment the interaction of the ball bearing with the ratcheting mechanism and indentation allow the user to determine when the playing pieces are being moved, and when they are in correct alignment respectively.

In one embodiment said feedback may be provided for by an interaction between said centroid and said playing pieces. Said feedback mechanism may be as described above or any other mechanism that allows the user to determine when the playing pieces are being moved, and when they are in correct alignment respectively.

In one embodiment said three dimensional puzzle is a sphere, wherein said area forms the outer surface of said spherical puzzle.

In one embodiment said area is substantially flat. In alternate embodiments said area may have alterations, indentations, projections, contours, markings or the like.

Preferably said area surface alterations, indentations, projections, contours, markings or the like are in a form so as to allow said playing pieces to be migrated about said three-dimensional sphere without interference from adjacent playing pieces.

In one embodiment one or more (or all), of an edge or part thereof, of a playing piece is/are rounded. Preferably at least one corner of a playing piece is rounded. More preferably each corner of a substantially triangular playing piece (of the area's peripheral surface) is rounded.

In one embodiment said surface alterations, indentations, projections, contours, markings or the like, may be in many different forms including different shapes, colours etc.

In one embodiment said sphere may be configured as a "lunar ball" wherein said surface alterations are to give a sense of a lunar landscape.

In a further embodiment said sphere may be configured as a globe, wherein said surface alterations are to convey an earth-like sphere.

In a further embodiment said sphere may be configured as a face wherein said playing pieces exhibit a facial feature, and wherein the migration of said playing pieces can form different configurations of facial features.

In a further aspect the present invention consists in a three-dimensional puzzle in accordance as aforesaid wherein the aim of the game is to align given patterns to complete the sphere. Such patterns may, for example, be to promote education e.g. spelling.

A feature of the aforementioned forms of the present invention is the avoidance of triangular form component of side greater in size than those of the individual squares.

In some forms of the present invention some adjacent square forms can instead be of a rectangular form, i.e. by being inter-engaged but this is far less preferred.

Examples of form of construction of such a puzzle is preferably substantial as herein after described with reference to the magnetic core approach but any variation of any of the forms of component interaction hither to use with, for example, Rubik's cube can be used.

Preferably the sides of the generally square forms and the generally triangular forms are equal although in some embodiments further reduction to a triangular form can be made such that there are a multiplicity of a subset of triangular forms which together co-act to form the triangular form aforesaid.

Preferably selective regions migrate collectively relative to other regions or vice versa under the inputs of a user of the puzzle or a user of the platform.

In one embodiment, each puzzle piece is connected to a centroid using magnetic attraction.

In one embodiment said centroid is magnetic. Preferably said magnetism of said magnetic centroid is provided for by a rare earth magnet. Preferably said playing pieces have a connector element that facilitates said magnetic attraction to said centroid. Preferably said connector element is a ferrous metal.

In one embodiment the connector element is, or comprises, a magnet. Preferably said magnet is a raw earth metal. Preferably said magnet is located distal to the surface of said puzzle piece. In this embodiment said centroid facilitates said magnetic attraction to said playing pieces. Preferably said centroid is, or comprises, a ferrous metal, steel ball, or a hollow steel ball. Preferably said magnet is embedded and recessed into the puzzle piece so as to not touch the centroid.

Preferable said playing pieces are arranged symmetrically around the periphery of the centroid.

Preferably each puzzle piece is a single moulded unit.

A number of different combinations of the three elements that comprise a playing piece (area, spacer and connector element), may be integrally moulded.

In one embodiment said area is in the form of a tile, said tile associates with a said spacer, which in turn associates with a said connector element.

Preferably said connector element is magnetised.

Preferable each puzzle piece interfaces with said centroid so as to be placed at a puzzle position relative to said centroid.

Preferably said three dimensional puzzle is made from wood, plastic or metal, or a combination, or any other suitable material.

In a further aspect the present invention consists in, in combination, or separately 1. A component of a first kind,
2. a component of a second kind, and
3. a ferro magnetic or magnetic member to which one or both said component types is attractable by magnetic forces, the or each component being of a kind which can be substantially tessellated to define a generally spherical effect with the individual areas of the components.

Preferably said first type components are of a square form in the display area thereof and/or the components of a second kind are of a triangular form. Preferably each of the components is a skeletal or actual wedge type form having a truncated end to the wedge adapted for magnetic attachment. The greater area end being that of a display end.

In a further aspect the present invention may consist of a three-dimensional puzzle or display area as aforesaid, yet having an external shape that departs from a sphere. For example, a puzzle or display area may be formed with any external shape, e.g. square form, so long as each playing piece may migrate without interference form adjacent playing pieces.

In a further aspect the present invention is an assembly comprising a three-dimensional puzzle or display platform as described herein in conjunction with a levitator, such that said levitator causes said three-dimensional puzzle or display platform to levitate.

In a further aspect the present invention is a puzzle having a centroid (solid or otherwise), and a plurality of pieces capable of providing a substantially tessellated array of such pieces to surround the centroid, wherein there is a magnetic attractive interaction between each piece and the centroid, and wherein the proximal to the centroid region of each piece carries the material magnetically interactive with the centroid, and wherein each piece has (a) its largest piece to piece touching zone dimension, when viewed radially of the pieces surrounded core, equal to or longer than, (B), its depth from such touching zone to the centroid proximal material of the piece.

Preferably said levitator comprise one of either:

1. at least two stands orientated above and below said three-dimensional puzzle or display platform,
2. one stand oriented above said three-dimensional puzzle or display platform and causes levitation of said three-dimensional puzzle or display platform by use of attractive magnetic forces, or
3. one said oriented below said three-dimensional puzzle or display platform and causes levitation of said three-dimensional puzzle or display platform by use of repulsive magnetic forces.

In a further aspect the present invention is, in combination, a three-dimensional puzzle or display platform as described herein and at least a levitating device capable when the or each device is standing and/or depending from a support of levitating the three-dimensional puzzle or display platform.

Preferably the exterior surface of said three-dimensional puzzle or display platform is substantially of one polarity (i.e. either north or south).

In one embodiment utilising (1) above, said stand above is of a polarity opposite to that of said three-dimensional puzzle or display platform. Said stand below is of the same polarity as said three-dimensional puzzle or display platform.

Preferably the polarity of the surface of said three-dimensional puzzle or display platform is substantially north. Preferably the polarity of the stand above is south and the stand below is north.

In one embodiment utilising (2) above said stand is of a polarity opposite to that of said three-dimensional puzzle or display platform.

Preferably the polarity of the surface of said three-dimensional puzzle or display platform is substantially north. Preferably the polarity of the stand is south.

In one embodiment utilising (3) above said stand is of a polarity equal to that of said three-dimensional puzzle or display platform.

Preferably the polarity of the surface of said three-dimensional puzzle or display platform is substantially north. Preferably the polarity of the stand is north.

In one embodiment said three-dimensional puzzle or display platform is defined as comprising the following:

1. a non magnetic centroid core,
2. playing pieces arranged around said centroid.

Preferably at least every alternate playing piece comprised a magnetic element. More preferably each playing piece comprises a magnetic element.

Preferably said levitator comprises one or more magnets.

In one embodiment said levitator is dish-shaped such that the corners of the dish are uplifted in respect with the central portion of the dish. Preferably each corner portion contains a magnet. More preferably magnets are located in each corner portion and at least one or more magnets are located centrally in respect of the dish.

In an alternate embodiment said levitator may comprise an exterior surface facing said sphere comprised of a mixture of polarities. Preferably said levitator is therefore comprised of at least two magnetic rings with said polarities vertically oriented. Preferably each magnetic ring has its polarity opposite to at least one other ring in said levitator.

Preferably said levitator comprises electromagnets.

Other aspects of the invention may become apparent from the following description which is given by way of example only and with reference to the accompanying drawings.

As used herein "tessellated", substantially tessellated", etc is of more than a single shape repeating in the resultant surface.

As used herein the term "and/or" means "and" or "or".

As used herein the term "s" following a noun means the plural or singular form of that noun as might be appropriate and not necessarily dependent on the syntax in which it is present as to which is meant.

As used herein reference to a "substantially square form" or "square form" is used interchangeably with "first playing piece".

As used herein reference to a "substantially triangular form" or "triangular form" is used interchangeably with "second playing piece".

As used herein a definition defined in a plural or singular form holds good for the opposite. i.e. the singular or plural form.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7).

As used herein "square form" refers to a puzzle piece having, when considered substantially normal to the general surface of a spherical puzzle, a substantially square form in respect of the positioning of the corners of the piece despite any minor indentations, markings or depression in the line of its periphery.

As used herein the term "core" is used interchangeably with the term "centroid".

As used herein "triangular form" refers to a puzzle piece having, when considered substantially normal to the general surface of a spherical puzzle, a substantially triangular form in respect of the positioning of the corners of the piece despite any minor indentations, markings or depression in the line of its periphery.

As used herein "equatorial" refers to any ring around said centroid whose axis passes through the centre of said centroid.

As used herein "Cartesian axis" refers to three axis of freedom of movement, each at 90° to each other.

As used herein "general sphere" refers to an object of a spherical shape notwithstanding any indentations, projections, contours or surface configurations.

This invention may also be the broadly to consist in the parts, elements and features referred to or indicated in the specification of the application, individually or collectively, and any or all combinations of any two or more of the parts, elements or features, and where specific integers are mentioned herein which have known equivalents in the art to which this invention relates, such known equivalents are deemed to be incorporated herein as if individually set forth.

The invention will now be described by way of example only and with reference to the drawings in which:

DETAILED DESCRIPTION OF THE INVENTION

Figure 1:
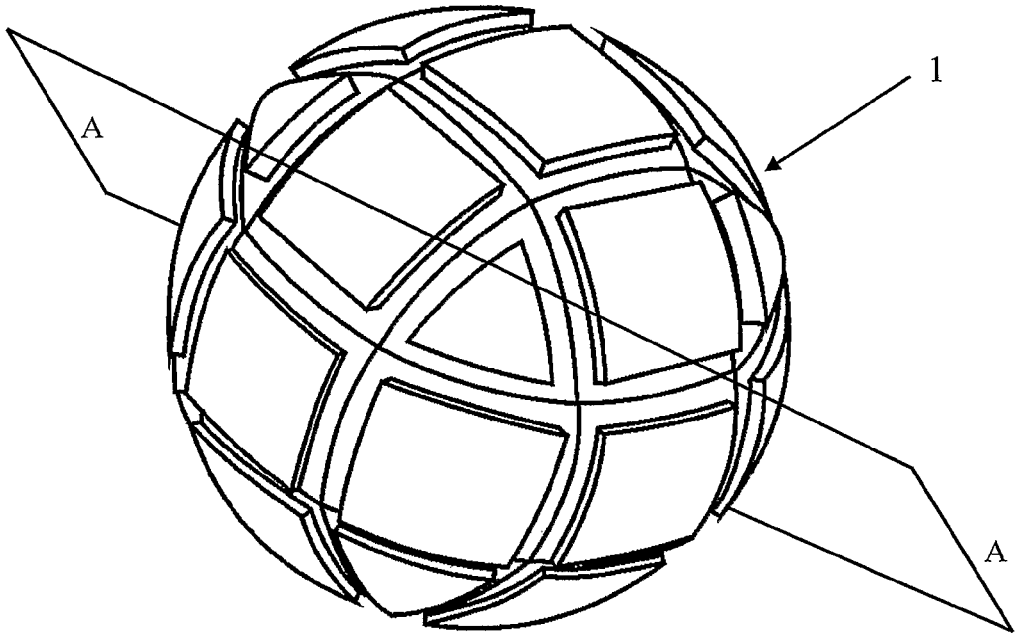
FIG. 1 is a perspective view of an embodiment of a three dimensional sphere comprising 26 playing pieces.
Figure 2:
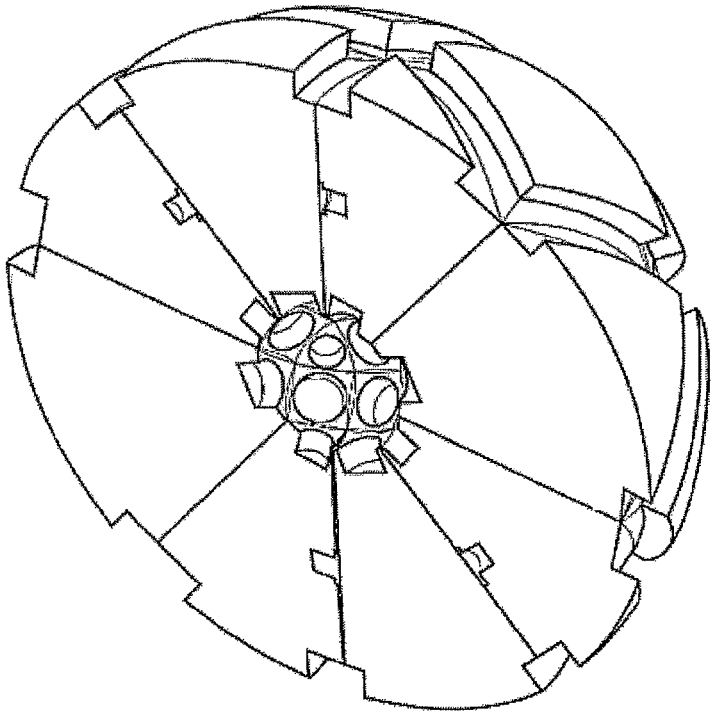
FIG. 2 is a perspective view a section taken through plane AA of FIG. 1.

With reference to FIG. 1, a three-dimensional sphere 1 in accordance with a preferred embodiment is shown. FIG. 2 shows a cross section through this sphere along A-A.

With reference to FIGS. 7 to 10, different configurations of puzzle pieces 2 are shown. Each playing piece 2 has an outer area 3 which forms the exterior surface of the three-dimensional sphere 1. This area 3 is connected to the centroid via a connector comprising a spacer 4 and a connector element 5.

Figures 7, 8:
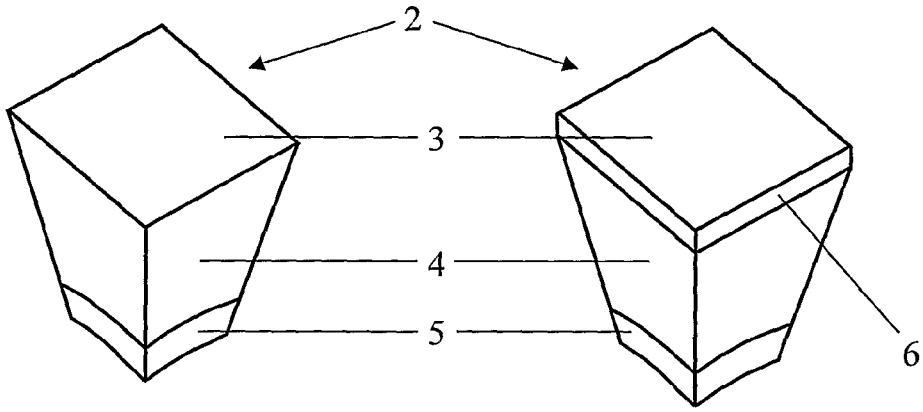
FIG. 7 is a perspective view of a puzzle piece.
FIG. 8 is a perspective view of a puzzle piece.

Many different combinations of the elements that comprise each puzzle piece can be integrally moulded. For example, as shown in FIG. 7, the puzzle area 2 may be integrally moulded with the spacer 4. Alternatively, as shown in FIG. 8, the puzzle piece 2 may comprise a separate puzzle area 2 which is then associated with a integrally moulded connector comprising the spacer 4 and connector element 5.

In some embodiments said area 3 may have indentations, projections, contours or surface configurations that project form the general surface of the sphere. In addition, due to the rounded shape of a sphere, the area 3 of each puzzle piece 2 may curve downwardly at its edges to help produce a more rounded sphere.

In one embodiment one or more (or all), of an edge or part thereof, of a playing piece is/are rounded. Preferably at least one corner of a playing piece is rounded. More preferably each corner of a substantially triangular playing piece (of the area's peripheral surface) is rounded. This helps facilitate smooth interaction between each adjacent playing piece 2.

Figures 9, 10:
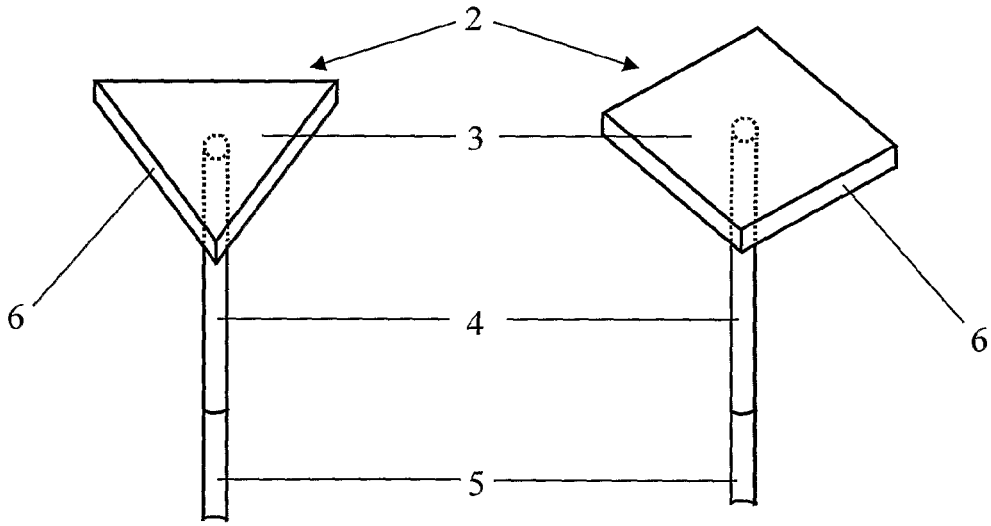
FIG. 9 is a perspective view of a puzzle piece.
FIG. 10 is a perspective view of a puzzle piece.

As shown in FIGS. 9 and 10, said puzzle piece 2 may comprise an area 3 in the form of a tile. In one embodiment each tile is connected to a centroid 7 via a connector 5, said connector comprising a spacer 4 and a connector element 5. A stated above, many different combinations of each element could be integrally moulded.

In a preferred embodiment, each puzzle piece 2 is connected to the centroid 7 using magnetic attraction.

It should be appreciated that a number of different configurations providing for the magnetic interaction can be provided. For example, each of said connectors 5, or part thereof, may be formed from a magnetic element. e.g. rare earth magnet, with the centroid 7, or part thereof, being formed from a ferrous metal. In this embodiment the centroid 7 may be formed as a spherical ball, a hollow spherical ball or a steel lattice ball surrounding the periphery of the centroid 7. Other configurations may also be used that allow rotation of said playing pieces 2 around the centroid. When configured as a steel latticed ball said centroid 7 is arranged such that the steel lattice lines are oriented around the centroid 7 so as to follow the lines of demarcation of the playing pieces 2. Alternately the steel lattice lines surrounding the periphery of the centroid 7 may be oriented so that the playing pieces 2 travel around the sphere over the said steel lattice lines.

In an alternate embodiment the centroid 7, or part thereof, may comprise the magnetic element and therefore the connector 5, or part thereof, comprise the ferrous element. Preferably the magnetic element used is a rare earth magnet. In such an instance the centroid 7 may be, for example, a spherical magnet, a hollow spherical magnet or a lattice ball of magnets surrounding the periphery of the centroid 7. Other configurations may also be used that allow rotation of said playing pieces 2 around the centroid 7. When used as a magnetic latticed ball said centroid 7 is arranged such that the lattice lines of the centroid magnets are oriented around the centroid 7 so as to follow the lines of demarcation of the playing pieces 2. Alternately the lattice lines of magnets surrounding the centroid may be oriented so that the playing pieces 2 travel around the sphere over the said lattice lines.

While FIGS. 8 to 10 depict the connector element 5 as a separate entity to that of the spacer 4 and the area 3 (whilst optionally integrally moulded), it is envisaged that the connector element may form an integral component of each puzzle piece 2. For example, said puzzle piece 2 may comprise, wholly or in part, a moulded material having magnetic properties.

Preferably when said puzzle piece(s) 2 comprises a magnet, said magnet is located distal to said area 3. i.e. located adjacent to the surface of said centroid 7.

Figure 15:
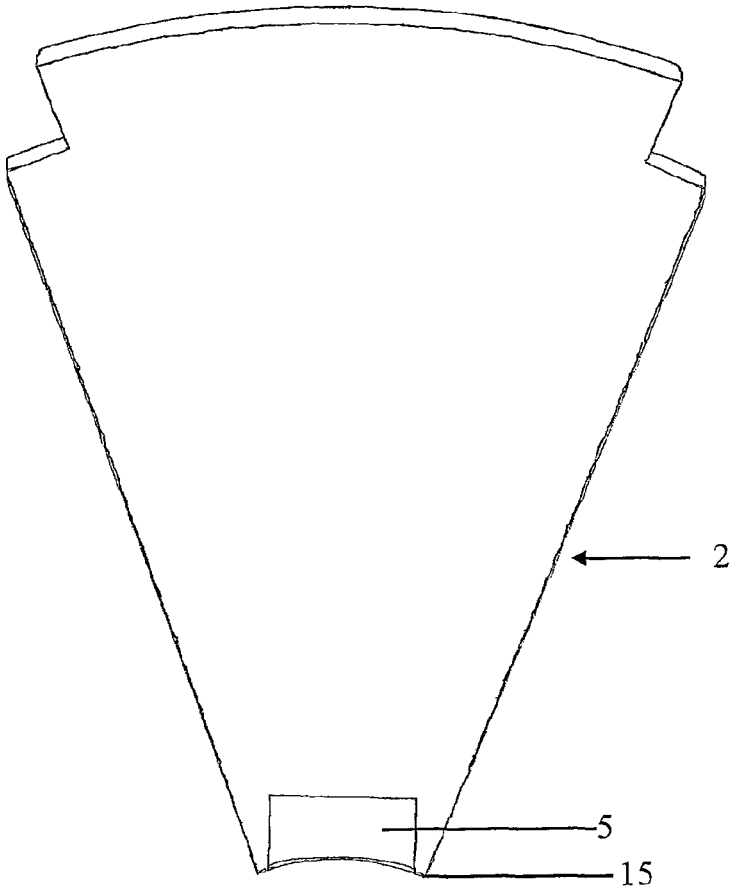
FIG. 15 is a cross-sectional view of a playing piece through BB.

In one embodiment the entire connector may be a magnet. In an alternate embodiment the magnet may only form a small part of the connector such that the magnet is embedded in the connector with only its lower surface (i.e that surface to be adjacent to said centroid 7) located at or near the lower surface of said puzzle piece 2. With reference to FIG. 15 the connector element 5 is shown as a magnet recessed into the playing piece 2. The lower periphery 15 of the puzzle piece can be seen to project beyond that of the magnet. Therefore, as the playing piece 2 is moved around the centroid 7 it is the material of the lower periphery 15 of the playing piece 2 (i.e. plastics) that contacts the centroid 7, and not the actual magnet itself. As shown in FIG. 15 the magnet projects only a short way up into the playing piece 2. It should be appreciated that many dimensions of magnets could be used. For example, magnets with dimensions that extend a greater proportion of the way into a puzzle piece 2, and/or magnets of varying width in relation to the width of the playing piece 2.

When said centroid 7 is in a hollow form it should be appreciated that any number of objects could be encased within the periphery of said centroid 7 such as a glow ball or the like.

As depicted in FIGS. 7 to 10, said puzzle area 3 forms a spherical surface with a diameter greater than that of the centroid 7. In order to achieve this, each puzzle piece 2 comprises a spacing element which projects the puzzle area 3 from the surface of the centroid. FIGS. 7 and 8 depict a wedge-shaped spacer 4, while FIGS. 9 and 10 depict a rod like mechanism. Alternate embodiments may also include spacers of a shape that can project puzzle area 3 from the surface of the contours. For example, contoured or scalloped shaped wedge-like spacers could be used. An advantage of such spacers as these is that they would project the puzzle area 3 from the surface of the centroid while using less material and retaining strength to render each puzzle piece 2 sufficiently resilient for use.

Figure 16:
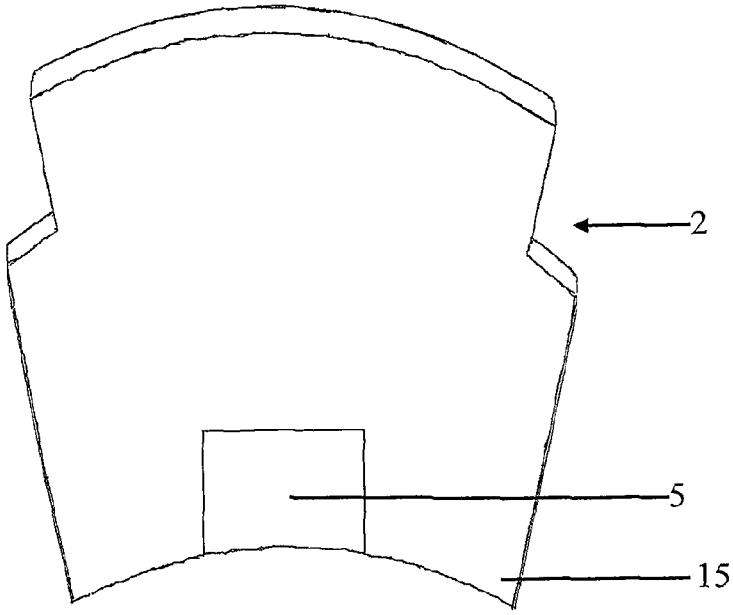
FIG. 16 is a cross-sectional view of a playing piece through BB.

It should be appreciated that the relative size of the centroid 7 to the total puzzle size can be varied. i.e. to put another way, it should be appreciated that the height of the playing pieces 2 could range greatly relative to the size of the centroid 7. For example, it can be seen that the ratio of the height to width is greater for the puzzle piece 2 shown in FIG. 15 compared to FIG. 16. It should also be appreciated that as the height of a playing piece 2 decreases relative to its width, the distance of the magnet to the edge of the playing piece can be increased therefore decreasing the magnetic interaction with other adjacent playing pieces. This can be seen when comparing the puzzle piece 2 of FIG. 16 to that of the puzzle piece 2 shown in FIG. 15.

It should also be appreciated that the magnetic element can extend any part thereof through the playing piece.

A number of different types of three-dimensional spheres are envisaged. Some non-limiting examples are as follows:

Sphere 1

With reference to FIGS. 1 and 2, in one embodiment said three-dimensional sphere 1 comprises twenty-six playing pieces of which eighteen are of the substantially square form and eight are of the substantially triangular form. In this particular embodiment the substantially square form playing pieces 2 are arranged in three equatorial bands, comprising 8 square form playing pieces each, along each of the three Cartesian axis. Therefore, each band can rotate around the centroid 7 at 90° relative to each other. Those squares that are placed at the intersection between two Cartesian bands (e.g. x-axis and y-axis) are therefore able to be rotated in either direction of each of the two Cartesian axis (e.g. horizontal or vertical). Each square may be rotated in a direction, as discussed, so that each square indexes to a position held by a previous square. For example, if the square playing pieces are rotated around said centroid 7 by one position, then they fill a playing position which was previously filled by an adjacent square playing piece. Said substantially square playing pieces may be rotated any number of playing positions.

With reference to a single Cartesian equatorial band, there also exists rotating caps that are comprised of substantially square form and substantially triangular form playing pieces 2. As there are three Cartesian equatorial bands, it should be apparent that there are two sets of caps per Cartesian axis. i.e. six said caps per sphere.

In a preferred embodiment said rotating caps are comprised of five substantially square form playing pieces and four substantially triangular form playing pieces. Said rotating caps rotate about the centroid in the same equatorial plane, but distal to, said single Cartesian equatorial reference band.

Preferably said cap is rotated two playing positions at a time. This ensures that said substantially triangular playing pieces fill a playing position filled previously by another triangular playing piece.

Figure 6:
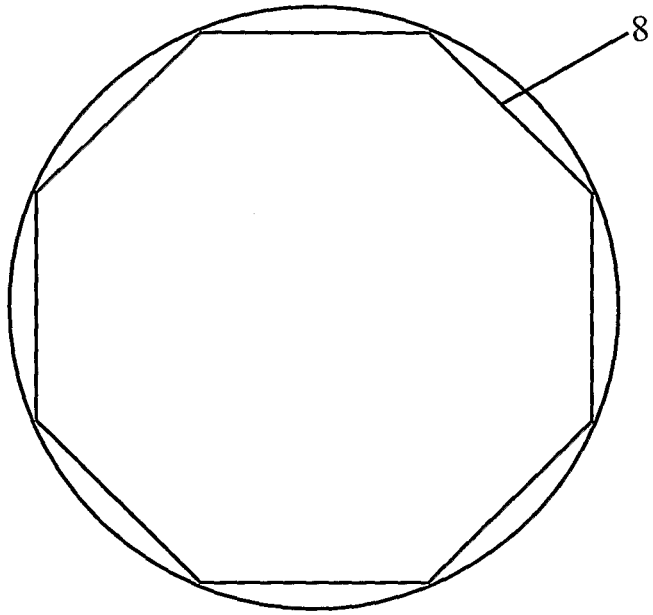
FIG. 6 is a side view of a puzzle of FIG. 1 showing the chord lengths.

Preferably the length of indexing sides of each of the substantially square and triangular form playing pieces are substantially similar are substantially similar to that of the playing piece they index to. More preferably the chord lengths 8 of each of the indexing sides of each playing piece are substantially similar. As used herein "chord length" is the length of the sides of the playing pieces when taken from corner to corner. As shown by FIG. 6, in a three-dimensional sphere comprising 8 squares in an equatorial band, the chord lengths 8 are the length of the sides (corner to corner) of each playing piece 2, when arranged as a octagon in a sphere.

Sphere 2

Figure 3:
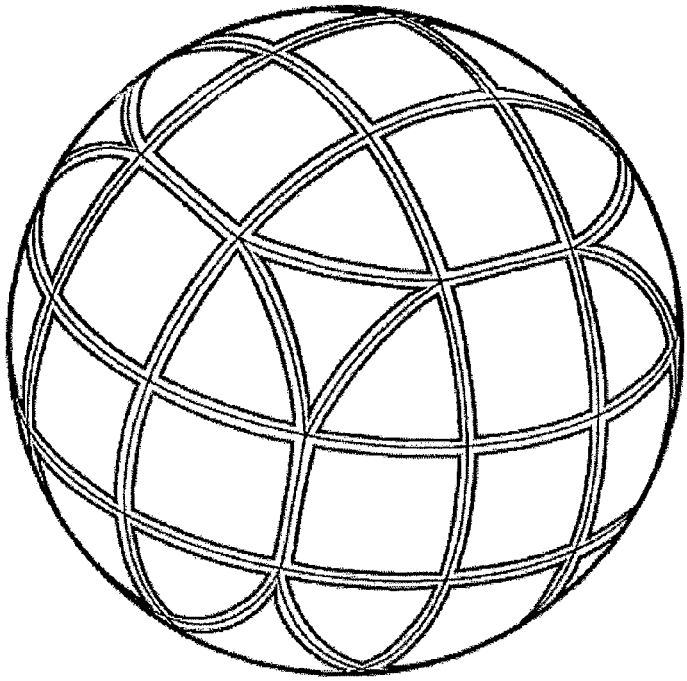
FIG. 3 is a perspective view of an embodiment of a three dimensional sphere comprising 62 playing pieces.

With reference to FIG. 3, in a further embodiment, said three-dimensional sphere comprises sixty-two playing pieces of which thirty are of a substantially square form and thirty two are of a substantially triangular form. In this particular embodiment the substantially square form playing pieces 2 are arranged in three equatorial bands, comprising 12 square form playing pieces each, along each of the three Cartesian axis. Therefore, each band can rotate around the centroid 7 at 90° relative to each other. Those squares that are placed at the intersection between two Cartesian bands (e.g. x-axis and y-axis) are therefore able to be rotated in either direction of each of the two Cartesian axis (e.g. horizontal or vertical). Each square may be rotated in a direction, as discussed, so that each square indexes to a position help by a previous square. For example, if the square playing pieces are rotated around said centroid 7 by one position, then they fill a playing position which was previously filled by an adjacent square playing piece. Said substantially square playing pieces may be rotated any number of playing positions.

With reference to a single Cartesian equatorial band, there also exists two rotating caps that are comprised of substantially square form and substantially triangular form playing pieces 2. As there are three Cartesian equatorial bands, it should be apparent that there are two sets of each cap per Cartesian axis. i.e. six of each a first and second said cap per sphere.

The first said rotating cap about the centroid in the same equatorial plane, but distal to, said single Cartesian equatorial reference band so that the base of the cap is the perimeter of said single Cartesian equatorial reference band. Said first rotating cap is comprised of nine substantially square form playing pieces and sixteen substantially triangular form pieces. Said substantially triangular form pieces are arranged as a multiplicity of a subset of triangular forms which together co-act to form a larger triangular piece.

In one embodiment said multiplicity of a subset of triangular forms comprise a larger triangular piece which is not subdivided.

The second said rotating cap is positioned distal to said rotating cap, and forms a subset of playing pieces of said first rotating cap. Preferably said second rotating cap comprises five substantially square form pieces and four substantially triangular form pieces.

Preferably said first cap is rotated three playing positions at a time. This ensures that said substantially triangular playing pieces fill a playing position filled previously by another triangular playing piece.

Preferably said second cap is rotated two playing positions at a time. This ensures that said substantially triangular playing pieces fill a playing position filled previously by another triangular playing piece.

Preferably the length of indexing sides of each of the substantially square and triangular form playing pieces are substantially similar to that of the playing piece they index to. More preferably the chord lengths 8 of each of the indexing sides of each playing piece are substantially similar. As used herein "chord length" is the length of the sides of the playing pieces when taken from corner to corner.

Sphere 3

Figure 4:
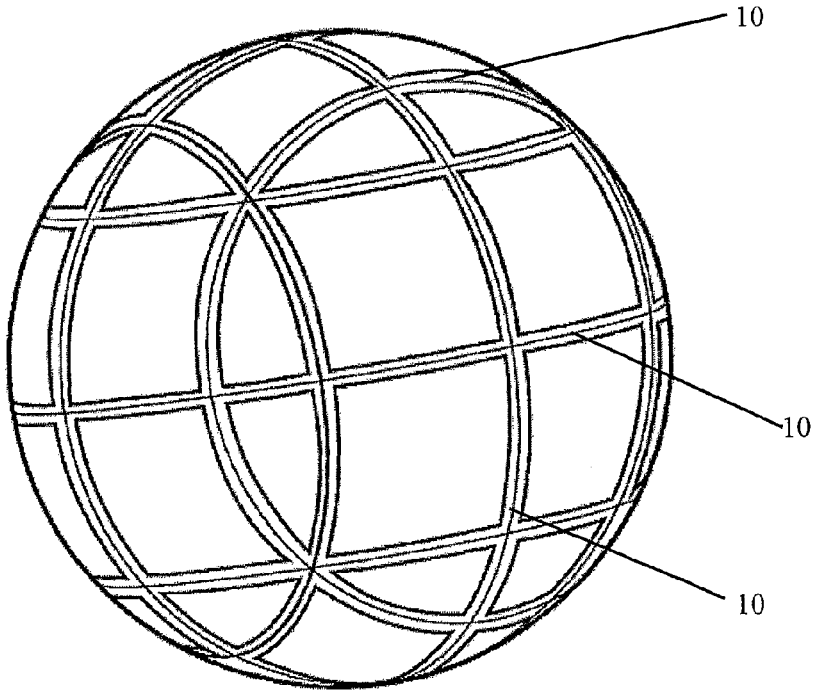
FIG. 4 is a perspective view of an embodiment of a three dimensional sphere comprising 54 playing pieces.
Figure 5:
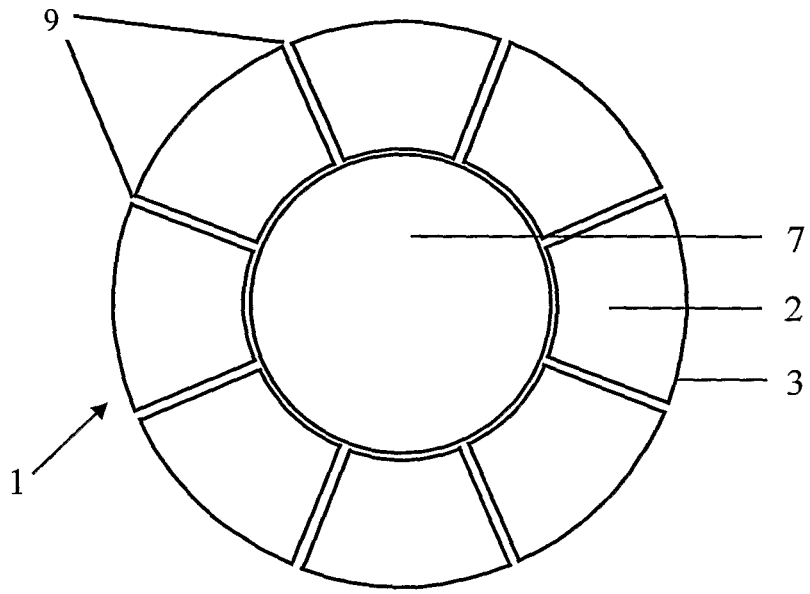
FIG. 5 is a cross-sectional view of a spherical puzzle of FIG. 1

With reference to FIG. 4, in one embodiment said three-dimensional sphere 1 comprises forty-eight playing pieces of which twenty-four are of the substantially square form and twenty-four are of the substantially triangular form. In this particular embodiment both said substantially square form playing pieces and substantially triangular form playing pieces are arranged in dual equatorial bands along each of the three Cartesian axis. As used herein "dual equatorial bands" refers to an arrangement whereby two adjacent bands of playing pieces 2 are arranged around said centroid 7 wherein each equatorial band lies either side of the sphere equator. This arrangement of dual equatorial bands are repeated in each of the three Cartesian axis. Each band comprises eight substantially square form playing pieces and 4 substantially triangular playing pieces (as seen in FIG. 4).

Each dual equatorial band can rotate around the centroid 7 at 90° relative to each other, whilst each band of the dual equatorial band arrangement rotates in the same plane of rotation as each other. Those squares that are placed at the intersection between two Cartesian bands (e.g. x-axis and y-axis) are therefore able to be rotated in either direction of each of the two Cartesian axis (e.g. horizontal or vertical). Each band may be rotated around said centroid 7 by 90° or multiples thereof.

With reference to a single Cartesian equatorial band, there also exists two rotating caps that are comprised of substantially square form and substantially triangular form playing pieces. As there are three Cartesian equatorial bands, it should be apparent that there are two sets of each cap per Cartesian axis. i.e. six of each a first and second said cap per sphere.

The first said rotating cap, by virtue of the presence of a equatorial demarcation line 10, allows rotation of one half of the sphere in relation to the remaining half. Said first rotating cap is comprised of twelve substantially square form playing pieces and twelve substantially triangular form pieces.

The second said rotating cap is positioned distal to said rotating cap, and forms a subset of playing pieces of said first rotating cap. Preferably said second rotating cap comprises four substantially square form pieces and eight substantially triangular form pieces.

Preferably said first cap is rotated 90° at a time. This ensures that both said substantially triangular and square form playing pieces fill a playing position filled previously by another triangular or square form playing piece respectively.

Preferably said second cap is rotated 90° at a time. This ensures that both said substantially triangular and square form playing pieces fill a playing position filled previously by another triangular or square form playing piece respectively.

Preferably the length of indexing sides of each of the substantially square and triangular form playing pieces are substantially similar to that of the playing piece they index to. More preferably the chord lengths 8 of each of the indexing sides of each playing piece are substantially similar. As used herein "chord length" is the length of the sides of the playing pieces when taken from corner to corner.

Indexing

In one embodiment the movement of said playing pieces 2 between playing positions provides feedback to the user. Said feedback allows the user to determine when the playing pieces are indexed correctly into a playing position. Preferably said feedback during movement provides at least one or more of the following outcomes:

a) a sense of moving beyond an indexed position, and b) a sense of indexing to a correct playing position.

Said feedback mechanism can be a noise, a "feel" i.e. due to a physical mechanism, or a change in a physical feature of said sphere 1 that can indicate to the user when the playing pieces 2 are moved, or correctly indexed to a playing position 2.

Figure 11:
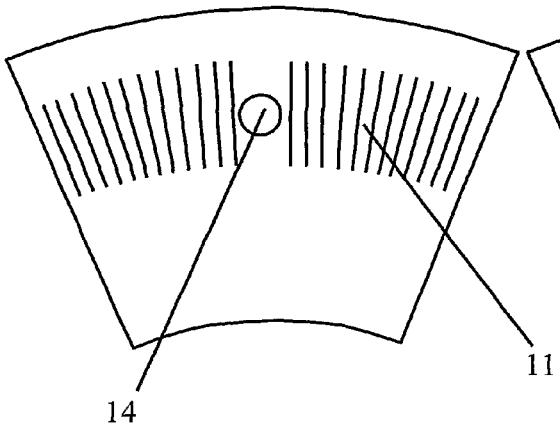
FIG. 11 is a side view of a playing piece showing the ratcheting mechanism and surface indentation.
Figure 12:
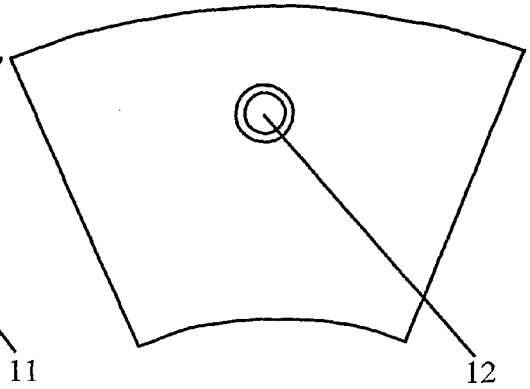
FIG. 12 is a side view of a playing piece showing the physical projection.
Figure 13:
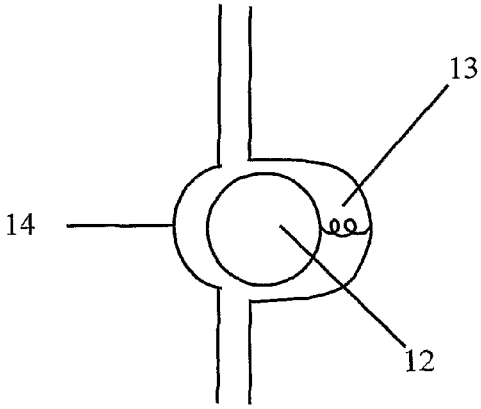
FIG. 13 is a side view of the interaction between two playing pieces showing the feedback mechanism.

With reference to FIGS. 11 to 13, in one embodiment said feedback mechanism is provided by a ratcheting mechanism 11 which provides a sound and/or a feel when said playing pieces 2 are moved due to the interaction with said ratcheting mechanism 11 with a physical projection that interacts with said ratcheting mechanism 11.

In one embodiment said ratcheting mechanism 11 is localised on the surface of a said playing piece (refer FIG. 11). Preferably said ratcheting mechanism 11 is localised on said substantially square form playing piece.

In one embodiment said physical projection is in the form of a projection that is on a playing piece that does not have localised thereto a ratcheting mechanism. Preferably said physical projection is able to interact with said ratcheting mechanism 11 to provide feedback to the user as to when a playing piece is moved.

In one embodiment wherein said ratcheting mechanism 11 is localised on said substantially square form playing piece, said physical projection is localised on said substantially triangular form playing piece. Preferably said physical projection is in the form of a ball bearing 12 or the like.

In one embodiment said ball bearing 12 is projected from a cavity in the side of said substantially triangular form playing piece so as to interact with said ratcheting mechanism 11 (refer FIGS. 12 and 13).

In one embodiment said ball bearing 12 is connected to a spring mechanism 13 which causes said ball bearing 12 to exert pressure on said ratcheting mechanism 11.

In one embodiment the feedback allowing the user to sense when the playing piece are correctly indexed is provided for by an indentation 14 in the side of the playing piece which interacts with said playing piece 2 containing the ball bearing 12 (refer FIG. 13). In this embodiment the interaction of the ball bearing 12 with the ratcheting mechanism 11 and indentation 14 allow the user to determine when the playing pieces are being moved, and when they are in correct alignment respectively.

In one embodiment said feedback may be provided for by an interaction between said centroid 7 and said playing pieces. Said feedback mechanism may be as described above or any other mechanism that allows the user to determine when the playing pieces are being moved, and when they are in correct alignment respectively.

Surface Shapes

Figure 14:
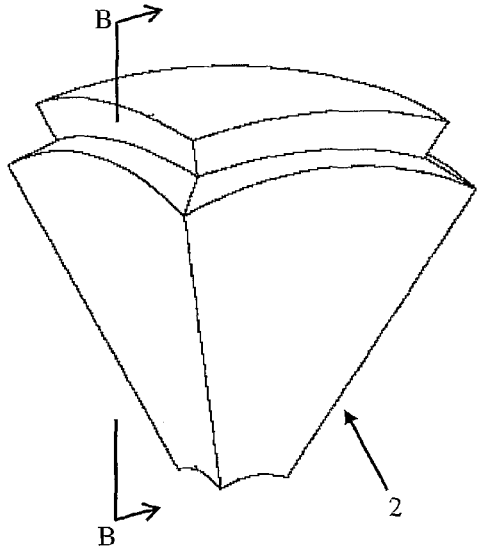
FIG. 14 is a perspective view of a playing piece.

In one embodiment said area 3 is substantially flat. In alternate embodiments said area 3 may have indentations, projections, contours, markings or the like. As shown in FIG. 14, said area may have surface alterations whilst still retaining the substantially square or triangular area form.

Alterations to the area 2 detracting from a substantially flat surface may be in any form so long as they allow the playing pieces 2 to be moved or indexed relative to each other without interference from adjacent playing pieces 2. Such surface alterations may be in many different forms including different shapes, colours etc.

In one embodiment said sphere 1 may be configured as a "lunar ball" wherein said surface alterations are to give a sense of a lunar landscape.

In a further embodiment said sphere 1 may be configured as a globe, wherein said surface alterations are to convey an earth-like sphere.

In a further embodiment said sphere 1 may be configured as a face wherein said playing pieces exhibit a facial feature, and wherein the migration of said playing pieces 2 can form different configurations of facial features.

In a further embodiment the overall shape of the puzzle may be of any other geometrical shape such as square or triangular. This can be achieved by the area of each playing piece being built up so that the overall shape of the puzzle becomes a desired geometrical shape. Thus rotation of the playing piece will result in uneven surface projections as a result of a non-spheroid outer geometrical shape rotating around a sphere form centroid 7 (e.g. rotation of a square around the spheroid centroid 7).

The novel three-dimensional spherical puzzle or display platform is susceptible to variations and modifications which may be introduced thereto without departing from the inventive concept. For example, the number of playing pieces 2 and the shape of the areas 2 may be modified.

In addition, it should be appreciated that whilst a spherical surface area is the preferred embodiment of the current invention, the external area may form other shapes such as a square shape as seen with Rubik's cubes.

Levitator

Figure 17:
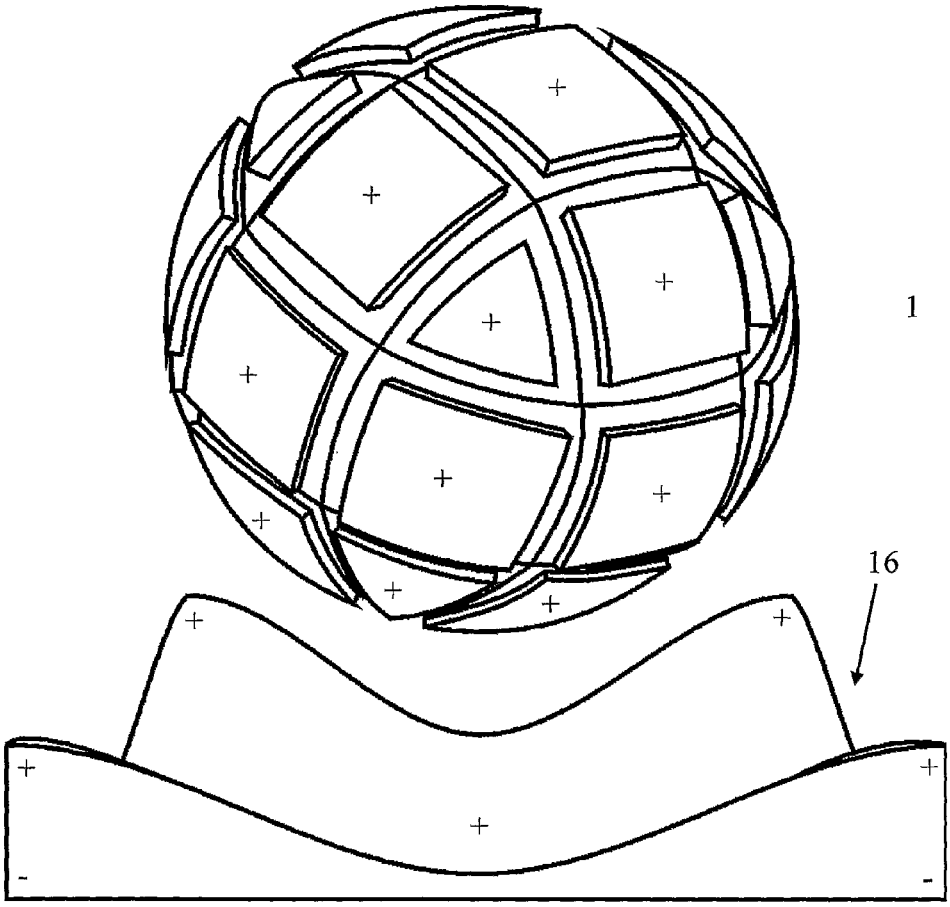
FIG. 17 is a side view of a preferred embodiment showing both a levitator and a three-dimensional puzzle or display platform.

With reference to FIG. 17, this shows a three-dimensional sphere 1 interacting with a single levitator 16 located below said three-dimensional sphere 1. As shown in FIG. 1, the exterior surface of the three-dimensional sphere 1 is preferably of a uniform polarity (i.e. either north or south).

It should be appreciated that the in some embodiments the surface of the sphere does not have to be of absolute uniform polarity, so long as the overall polarity of the surface of one polarity.

Alternately said levitator could have a mix of polarities. In one embodiment said levitator 16 is comprised of at least two rings of magnets. Said outer ring of magnets are of a polarity equal to that of the surface of the sphere, whereas the inner ring is of opposite polarity. Further inner rings may also be included of either polarity.

The levitator 16 can act upon a three-dimensional sphere 1 by using magnetic attractive or repulsive forces, or a combination of both. i.e. If a single levitator 16 is positioned below the three-dimensional sphere 1 is used, as depicted in FIG. 17, then the polarity of the surface of said levitator 16 must be of the same polarity as that of the surface of said three-dimensional sphere 1. If a single levitator 16 is positioned above said three-dimensional sphere 1 then is uses magnetic attractive forces to maintain levitation of said three-dimensional sphere 1. In this instance the overall polarity of the surface of the levitator 16 facing said three-dimensional sphere 1 must be opposite to the polarity of said three-dimensional sphere 1. If two levitators 16 are used, one above and one below said three-dimensional sphere 1, then the bottom levitator 16 will have its surface facing said three-dimensional sphere 1 having a polarity the same as the surface of said three-dimensional sphere 1, and the levitator 16 above said three-dimensional sphere 1 will have the polarity of its surface facing said three-dimensional sphere 1 as being the opposite of the polarity of the surface of said three-dimensional sphere 1.

Preferably the corners of the levitator(s) 16 are inclined as seen in FIG. 17. This creates lines of magnetic flux that will levitate said three-dimensional sphere 1 into the middle of the dish. It should be appreciated that any shaped levitator 16 can be used so long as the lines of flux are oriented so as to keep the levitator in a stable position.

In an alternative embodiment the magnet could be mounted gyroscopically inside of the centroid 7 so that the orientation of the magnets polarity is static relative to the orientation of the puzzle. In such an embodiment as this the connector element 5 of the puzzle piece could be formed of a ferrous metal. Therefore, the induced polarity of the ferrous metal would change as the puzzle piece 2 is rotated about the centroid therefore maintaining an attractive magnetic force with the centroid 7.

Example 1

A puzzle form of said sphere 1 can be used on the same basis as the Rubik's concept. i.e. each piece can be variously identified y colour, markings, contour etc, and thus rotation of pieces can be performed so as to achieve a particular pattern or game objective (e.g. pattern arrangement).

Example 2

An object of the game may be to start with the centroid only and add on each playing piece between competing players. Thus when the pieces are all arranged around the centroid, the aim of the game can be as aforesaid.

The invention claimed is:

1. A three-dimensional puzzle or puzzle or display platform of a kind having magnetic interactions between a solid or non-solid spherical core and plural pieces held, with or without contact, to the spherical core, comprising the plural pieces being of two kinds that collectively provide a substantially tessellated surface, one type of piece being at least notionally square when viewed towards the core and the second type of piece being at least notionally triangular when viewed towards the core, and chord lengths of each piece, four for each at least notionally square piece and three for each at least notionally triangular piece, being substantially equal, and the puzzle or display platform providing feedback when the pieces are rotated about the core, said feedback being provided for by a ratcheting mechanism or an indexing mechanism.

2. The three-dimensional puzzle or puzzle or display platform of claim 1, further comprising at least two parallel planes of demarcation on each of three Cartesian axes that define areas of said tessellated surface.

3. The three-dimensional puzzle or puzzle or display platform of claim 1, wherein said three-dimensional puzzle or platform has a capability whereby said group is a band of said pieces that is rotated about a notional spherical centre, and wherein said three-dimensional puzzle or puzzle or platform has a capability whereby said group is a cap of said pieces that is rotated about a notional spherical centre relative to said bands.

4. The three-dimensional puzzle or puzzle or display platform of claim 1, wherein each piece indexes with at least one or more of another piece.

5. The three-dimensional puzzle or puzzle or display platform of claim 1, wherein each said square piece indexes with four other pieces, and wherein each said triangular piece indexes with three other said pieces.

6. The three-dimensional puzzle or puzzle or display platform of claim 1, wherein said pieces are arranged symmetrically around said core.

7. The three-dimensional puzzle or puzzle or display platform of claim 1, wherein each said piece includes a) an exterior surface, and b) a connector comprising a spacer and a connector element.

8. The three-dimensional puzzle or puzzle or display platform of claim 7, wherein said exterior surface is located at a distal end of said connector, and wherein said connector element is located at a proximal end of said connector.

9. The three-dimensional puzzle or puzzle or display platform of claim 8, wherein said proximal region of said connector is held, with or without contact, to the core.

10. The three-dimensional puzzle or puzzle or display platform of claim 7, wherein said connector is integrally moulded.

11. The three-dimensional puzzle or puzzle or display platform of claim 1, wherein said pieces are integrally moulded.

12. The three-dimensional puzzle or puzzle or display platform of claim 1, comprising twenty-six pieces.

13. The three-dimensional puzzle or puzzle or display platform of claim 12, comprising eight of said triangular pieces and eighteen of said square pieces.

14. The three-dimensional puzzle or puzzle or display platform of claim 13, wherein said square pieces are arranged as bands about an equator of each of the three Cartesian axes arranged symmetrically around said core.

15. The three-dimensional puzzle or puzzle or display platform of claim 1, comprising fifty-four playing pieces.

16. The three-dimensional puzzle or puzzle or display platform of claim 15, comprising thirty square pieces and twenty-four triangular pieces.

17. The three-dimensional puzzle or puzzle or display platform of claim 16, wherein said square pieces are arranged about the core in dual bands along each of the three Cartesian axes arranged symmetrically around said core.

18. The three-dimensional puzzle or puzzle or display platform of claim 1, comprising sixty-two playing pieces.

19. The three-dimensional puzzle or puzzle or display platform of claim 15, comprising thirty square pieces and thirty two triangular pieces.

20. The three-dimensional puzzle or puzzle or display platform of claim 16, wherein said square pieces are arranged about the core in three adjacent bands along each of the three Cartesian axes arranged symmetrically around said core.

21. The three-dimensional puzzle or puzzle or display platform of claim 1, wherein said pieces are indexed to an adjacent position when moved.

22. The three-dimensional puzzle or puzzle or display platform of claim 1, wherein said feedback during movement provides at least one or more of the following outcomes: a) a sense of moving beyond an indexed position, and b) a sense of indexing to a correct playing position.

23. The three-dimensional puzzle or puzzle or display platform of claim 1 wherein said indexing or ratcheting mechanism is localized on said square piece.

24. The three-dimensional puzzle or puzzle or display platform of claim 23, wherein said mechanism includes a ball bearing and spring locatable on a single said piece and indexible into a cavity formed in an adjacent said piece.

25. The three-dimensional puzzle or puzzle or display platform of claim 24, wherein said ball bearing is projected from a cavity in the side of said triangular piece so as to project into a cavity located on an adjacent piece.

26. The three-dimensional puzzle or puzzle or display platform of claim 1, when said three-dimensional puzzle or puzzle or display platform has any overall shape, said shape characterised in that said pieces rotate around said core uninhibited.

27. The three-dimensional puzzle or puzzle or display platform of claim 1, wherein said exterior surface is substantially flat.

28. The three-dimensional puzzle or puzzle or display platform of claim 1, wherein said exterior surface has alterations, indentations, projections, contours, or markings.

29. The three-dimensional puzzle or puzzle or display platform of claim 1, wherein said triangular pieces are subdivided into four or more triangular pieces.

30. The three-dimensional puzzle or puzzle or display platform of claim 1, wherein there is magnetic interaction within said three-dimensional puzzle via any one or more of the following interactions:

between adjacent said pieces, between said pieces and said core, or between adjacent said pieces and also between said pieces and said core.

31. The three-dimensional puzzle or puzzle or display platform of claim 1, wherein an edge or part thereof, of a piece is/are rounded.

32. The three-dimensional puzzle or puzzle or display platform of claim 22, wherein at least one corner of a playing piece is rounded.

33. The three-dimensional puzzle or puzzle or display platform of claim 31, wherein each corner of a triangular piece is rounded.

34. The three-dimensional puzzle or puzzle or display platform of claim 7, wherein said connector element is a magnet or ferrous metal.

35. The three-dimensional puzzle or puzzle or display platform of claim 1, wherein said core is or includes, a ferrous metal, steel ball, or a hollow steel ball.

36. The three-dimensional puzzle or puzzle or display platform of claim 1, wherein said core is magnetic.

37. The three-dimensional puzzle or puzzle or display platform of claim 1, wherein said three-dimensional puzzle or puzzle or display platform is made from wood, plastic or metal, or a combination, or any other suitable material.

38. The three-dimensional puzzle or puzzle or display platform as claimed in claim 1, wherein each piece has (A) its largest piece to piece touching zone dimension, when viewed radially toward the core, equal to or longer than, (B), its depth from the touching zone to a centroid proximal material of the piece.

39. The three-dimensional puzzle or puzzle or display platform as claimed in claim 1, in conjunction with at least a levitation device capable of levitating the three-dimensional puzzle or puzzle or display platform.

40. The three-dimensional puzzle or puzzle or display platform of claim 39, wherein said levitation device includes at least one stand oriented below said three-dimensional puzzle or display platform and causes levitation of said three-dimensional puzzle or display platform by use of repulsive magnetic forces.

41. The three-dimensional puzzle or puzzle or display platform of claim 39, wherein said levitation device is substantially of one polarity.

42. The three-dimensional puzzle or puzzle or display platform of claim 40, wherein said stand is of a polarity equal to that of said three-dimensional puzzle or display platform.

43. The three-dimensional puzzle or puzzle or display platform of claim 39, wherein said levitation device includes one or more magnets.

44. The three-dimensional puzzle or puzzle or display platform of claim 43, wherein said levitation device is dish-shaped such that corners of the dish are uplifted with respect to a central portion of the dish.

45. The three-dimensional puzzle or puzzle or display platform of claim 44, wherein said magnets are located in each corner portion and at least one or more magnets are located centrally with respect to the dish.

46. The three-dimensional puzzle or puzzle or display platform of claim 39, wherein said levitation device includes an exterior surface facing said spherical core having a mixture of polarities.

47. The three-dimensional puzzle or puzzle or display platform of claim 46, wherein said levitation device includes a ring of magnets.

48. The three-dimensional puzzle or puzzle or display platform of claim 39, wherein said levitation device includes electromagnets.

* * * * *

UNITED STATES PATENT AND TRADEMARK OFFICE

CERTIFICATE OF CORRECTION

PATENT NO. : 8,490,974 B2
APPLICATION NO. : 11/665998
DATED : July 23, 2013
INVENTOR(S) : Mark Randall Stolten It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1091 days.

Signed and Sealed this
Eighth Day of September, 2015

Michelle K. Lee

Michelle K. Lee
*Director of the United States Patent and Trademark Office*